US008737903B2

(12) United States Patent
Son et al.

(10) Patent No.: US 8,737,903 B2
(45) Date of Patent: May 27, 2014

(54) METHOD AND APPARATUS FOR FORMING IMAGE

(75) Inventors: Jung-woo Son, Seoul (KR); Cheol-ju Yang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 922 days.

(21) Appl. No.: 12/170,755

(22) Filed: Jul. 10, 2008

(65) Prior Publication Data

US 2009/0034993 A1 Feb. 5, 2009

(30) Foreign Application Priority Data

Aug. 3, 2007 (KR) ..... 10-2007-0078185

(51) Int. Cl.
*G03G 15/00* (2006.01)

(52) U.S. Cl.
USPC ..... 399/388; 399/23; 399/167; 271/3.15; 271/110

(58) Field of Classification Search
USPC ..... 399/21, 22, 388, 302, 23, 167; 271/10.02, 10.03, 265.01, 3.15
See application file for complete search history.

(56) References Cited

U.S. PATENT DOCUMENTS

| | | | | |
|---|---|---|---|---|
| 6,546,220 | B1 * | 4/2003 | Asakura et al. | 399/227 |
| 6,661,981 | B2 * | 12/2003 | Boothe et al. | 399/44 |
| 7,052,007 | B2 * | 5/2006 | Yang et al. | 271/10.02 |
| 8,019,237 | B2 * | 9/2011 | Bober | 399/21 |
| 2005/0035526 | A1 | 2/2005 | Yang et al. | |
| 2006/0269316 | A1 * | 11/2006 | Kyung et al. | 399/101 |

FOREIGN PATENT DOCUMENTS

| | | |
|---|---|---|
| CN | 1577174 | 2/2005 |
| JP | 2003-241480 | 8/2003 |

OTHER PUBLICATIONS

Chinese Office Action mailed May 11, 2012 issued in corresponding Chinese Patent Application No. 200810145515.5.
Chinese Office Action mailed Jan. 22, 2013 for corresponding Chinese Application No. 200810145515.5.
Chinese Reexamination Notification issued on Jan. 15, 2014 in corresponding Chinese Application No. 200810145515.5.

* cited by examiner

*Primary Examiner* — Matthew G Marini
(74) *Attorney, Agent, or Firm* — Staas & Halsey LLP

(57) ABSTRACT

A method and apparatus for forming an image determine if printing paper is properly picked up, and printing data is transferred to an intermediate transfer belt (ITB). When it is sensed that the printing paper is not properly picked up, picking up the printing paper is retried considering a revolution cycle of the ITB. Thus, the frequency of errors can be decreased, and a user's convenience can be increased because picking up the printing paper is automatically retried whenever mis-pick up occurs instead of displaying an error. Further, wasting of toner is decreased.

15 Claims, 3 Drawing Sheets

METHOD AND APPARATUS FOR FORMING IMAGE

CROSS-REFERENCE TO RELATED APPLICATION

This application claims the benefit of Korean Patent Application No. 2007-78185, filed on Aug. 3, 2007 in the Korean Intellectual Property Office, the disclosure of which is incorporated herein by reference.

BACKGROUND OF THE INVENTION

1. Field of the Invention

Aspects of the present invention relate to a method and apparatus for forming an image, and more particularly, to a multi-pass image forming apparatus and a method for forming an image when mis-pick up occurs in the multi-pass image forming apparatus.

2. Description of the Related Art

In general, a color image forming apparatus receives a digital image signal corresponding to a desired image, forms an electrostatic latent image on a photosensitive medium using an exposure unit (such as a laser scanning unit (LSU)), develops the electrostatic latent image using a developer in order to develop printing data, transfers the electrostatic image to printing paper, and fuses the electrostatic image on the printing paper by applying heat and pressure thereto to form a desired color image. The color image forming apparatus uses yellow (Y), magenta (M), cyan (C), and black (K) toners. Thus, the color image forming apparatus requires four developers in order to apply the four toners to the photosensitive medium as the electrostatic latent image.

Color image forming apparatuses may be classified into a single-pass image forming apparatus and a multi-pass image forming apparatus. The single-pass color image forming apparatus includes four exposure units and four photosensitive media, and the multi-pass color image forming apparatus generally includes a single exposure unit and a single photosensitive medium. The single-pass color image forming apparatus is widely used to print images at high speed, i.e., the single-pass color image forming apparatus prints a color image as quickly as a black-and-white image. However, the single-pass color image forming apparatus requires four exposure units and four photosensitive media, and thus the single-pass color image forming apparatus is expensive and not suitable for miniaturization.

In the case of the multi-pass color image forming apparatus, the exposure, developing, and transfer processes are repetitively performed for respective colors to form color images. The formed color images are superposed on an intermediate transfer belt (ITB), so that color printing data are developed, transferred, and fused to printing paper.

FIG. 1 is a view showing the construction of a conventional multi-pass image forming apparatus. Referring to FIG. 1, the conventional multi-pass image forming apparatus includes an electrification roller 110, a developing roller 120, an exposure unit 130, an organic photo conductor (OPC) drum 140, a first transfer roller 150, a second transfer roller 153, an Intermediate Transfer Belt (ITB) 156, driving rollers 159, a pick up solenoid 160, a pick up roller 163, a cassette 166, a registration solenoid 170, a registration roller 173, a registration sensor 176, a fusing roller 180, an output roller 190, and an output sensor 193.

A process of forming an image using the above-described multi-pass image forming apparatus will now be described. The electrification roller 110 rotates in contact with or out of contact with an outer surface of the OPC drum 140 to supply electric charges to the OPC drum 140 and electrifies the outer surface of the OPC drum 140 to a uniform electric potential. The exposure unit 130 irradiates light corresponding to image information on the electrified OPC drum 140 and forms an electrostatic latent image. Generally, the exposure unit 130 may be an LSU using a laser diode (LD) as a light source. The developing roller 120 supplies a toner to the OPC drum 140 to develop printing data. In order to transfer the printing data developed on the OPC drum 140 to the ITB 156, a first bias voltage is applied to the first transfer roller 150. The ITB 156 is driven by the driving rollers 159. The second transfer roller 153 is installed opposite to the ITB 156. The second transfer roller 153 is spaced apart from the ITB 156 during the transfer of the printing data from the OPC drum 140 to the ITB 156, and comes into contact with the ITB 156 under a predetermined pressure when the printing data is completely transferred to the ITB 156.

Meanwhile, printing paper to which the printing data is to be transferred passes between the ITB 156 and the second transfer roller 153 and is picked up as follows. When a predetermined voltage is applied to the pick up solenoid 160, the pick up roller 163 picks up the printing paper from the cassette 166 in which the printing paper is stored. When the registration roller 173 is driven by the registration solenoid 170, the printing paper that is picked up by the pick up roller 163 is conveyed to the second transfer roller 153. The registration sensor 173 senses a front end of the picked-up printing paper to confirm that the printing paper is normally picked up by the pick up roller 163, and aligns the printing paper. The printing data transferred from the ITB 156 is transferred to the printing paper that is conveyed to the second transfer roller 153. The printing paper to which the printing data is transferred is fixed by the fusing roller 180 and output via the output roller 190. The output sensor 193 senses the printing paper and confirms that the printing paper is output.

When forming a mono-color or multi-color image using the multi-pass image forming apparatus, the apparatus outputs an error message even in the case of only one mis-pick up. As a result, even if only one mis-pick up occurs due to for example, a mechanical slip, the apparatus directly outputs an error message and the frequency of errors increases. Also, when forming an image using the multi-pass image forming apparatus, a process of picking up printing paper is performed separately from a process of transferring printing data to the ITB. Thus, even if mis-pick up occurs, the printing data is already transferred to the ITB, thereby wasting toner.

SUMMARY OF THE INVENTION

Aspects of the present invention provide a method and apparatus for forming an image in which if a printing paper is not properly picked up due to a mechanical slip, the picking up of the printing paper is retried under predetermined retrial conditions instead of directly outputting an error message so that the frequency of errors reported and toner waste can be decreased. Also, aspects of the present invention provide a computer-readable medium having embodied thereon a computer program for executing the foregoing method.

According to an aspect of the present invention, there is provided a method of forming an image, including: picking up a printing paper; determining if the printing paper is properly picked up; transferring printing data to an intermediate transfer belt (ITB); and retrying the picking up of the printing paper according to a revolution cycle of the ITB when the printing paper is not properly picked up.

According to another aspect of the present invention, there is provided an apparatus for forming an image, including: a pick up unit to pick up a printing paper from a cassette; a pick up sensing unit to sense if a printing paper is properly picked up from the cassette; a transfer unit to transfer printing data to an ITB; and the pick up unit retries picking up the printing paper according to a revolution cycle of the ITB.

According to yet another aspect of the present invention, there is provided a computer-readable medium having embodied thereon a computer program for executing the method of forming an image.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other features and advantages of the present invention will become more apparent by describing in detail exemplary embodiments thereof with reference to the attached drawings in which.

DETAILED DESCRIPTION OF THE EMBODIMENTS

Figure 1:
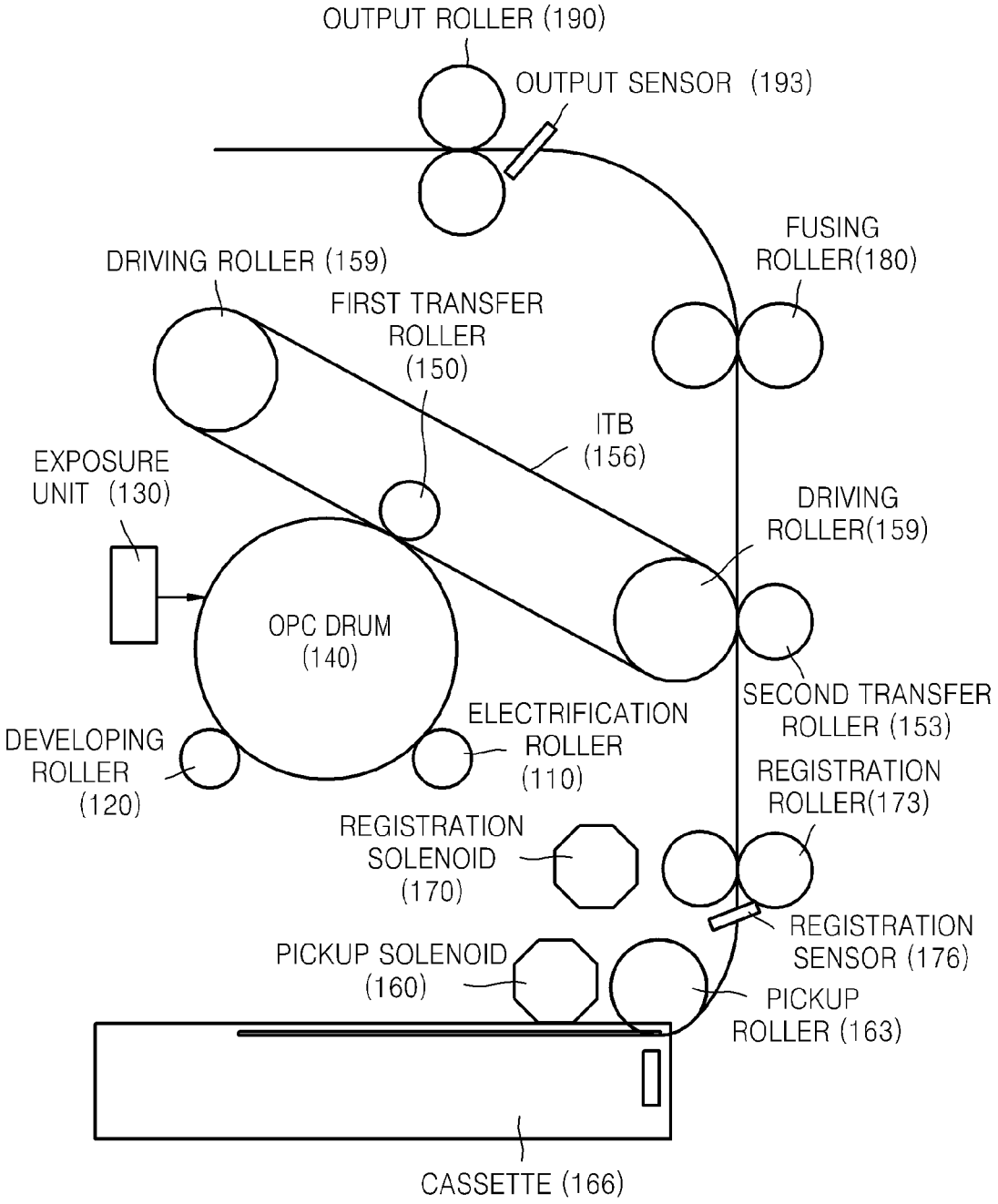
FIG. 1 (RELATED ART)
FIG. 1 is a view showing the construction of a conventional multi-pass image forming apparatus.

Reference will now be made in detail to the present embodiments of the present invention, examples of which are illustrated in the accompanying drawings, wherein like reference numerals refer to the like elements throughout. The embodiments are described below in order to explain the aspects of the present invention by referring to the figures.

Figure 2:
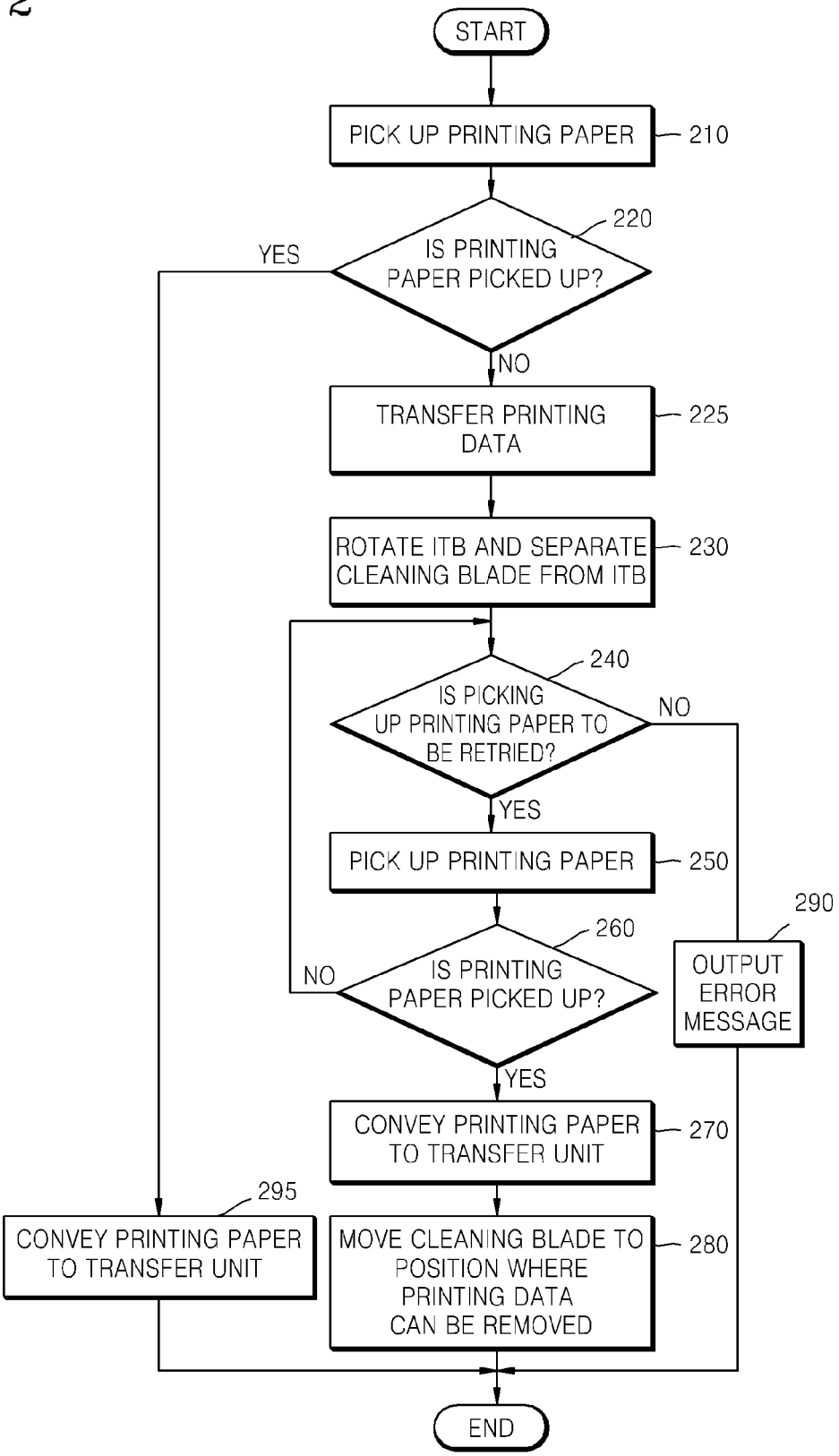
FIG. 2 is a flowchart illustrating a method of forming an image according to an embodiment of the present invention.
Figure 3:
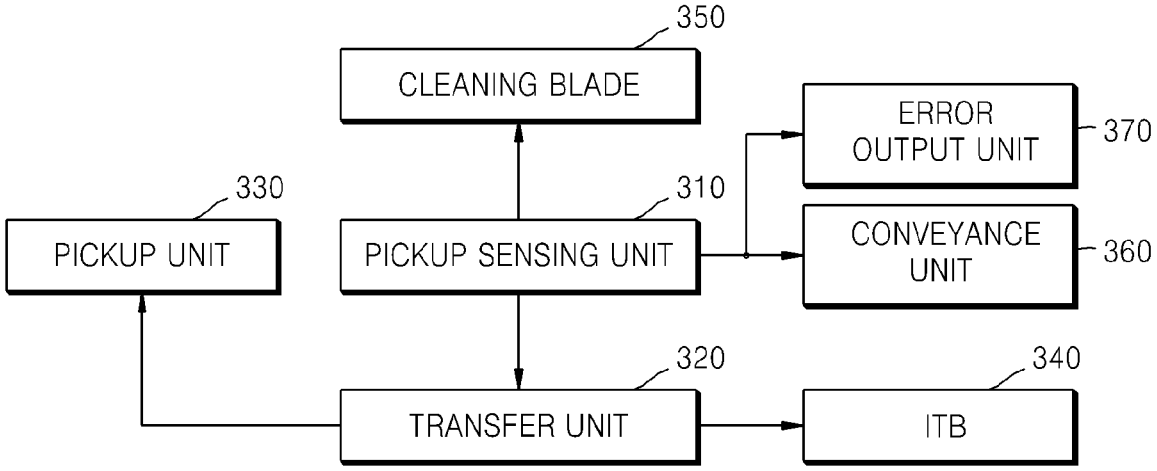
FIG. 3 is a block diagram of an image forming apparatus according to an embodiment of the present invention.

FIG. 2 is a flowchart illustrating a method of forming an image according to an embodiment of the present invention, and FIG. 3 is a block diagram of an image forming apparatus according to an embodiment of the present invention. Aspects of the present invention can be applied to new or conventional apparatuses, such as the conventional apparatus shown in FIG. 1. As such, by way of example, reference will be made to elements in FIG. 1 without limitation thereto. However, it is understood that the paper can be stored in a cassette as shown in FIG. 1, in a tray, or be manually fed. Referring to FIG. 2, the image forming apparatus picks up printing paper in operation 210. When receiving a printing command from a predetermined system (not shown), the image forming apparatus applies a voltage to a pick up solenoid (similar to reference number 160 in FIG. 1) to drive a pick up roller (similar to reference number 163 in FIG. 1) and picks up the printing paper.

In operation 220, the image forming apparatus senses if the printing paper is properly picked up. When the image forming apparatus neither picks up the printing paper nor senses the printing paper, the process proceeds to operation 225. When the image forming apparatus senses the printing paper, the process proceeds to operation 295. In order to sense if the printing paper is picked up, a registration sensor (similar to reference number 176 in FIG. 1) may be used, but the aspects of the invention are not limited thereto. In operation 225, the image forming apparatus transfers printing data to an intermediate transfer belt (ITB) (similar to reference number 156 in FIG. 1).

When the printing paper is not sensed in operation 220, the ITB 156 makes another revolution and a cleaning blade is separated from the ITB 156 in order to prevent removal of the printing data remaining on the ITB 156 in operation 230. The ITB 156 stores the printing data to be transferred to the printing paper. The cleaning blade removes the printing data from the ITB 156 after the printing data is transferred to the printing paper by a second transfer roller (similar to reference number 153 in FIG. 1).

In operation 240 and with the cleaning blade separated, the image forming apparatus determines if the picking up of the printing paper is to be retried. If it is determined that picking up the printing paper is to be retried, the process proceeds to operation 250. If it is determined that picking up the printing paper is not to be retried, the process proceeds to operation 290. In order to determine if picking up the printing paper is to be retried, the following methods and/or other methods may be used.

In an embodiment of the present invention, in operation 240, the image forming apparatus may determine to retry picking up the printing paper when the number of times the picking up the printing paper is retried is less than N (N is a natural number). For example, in a multi-pass image forming apparatus of forming a mono-color image, a cycle in which the ITB 156 makes one revolution may be measured by timing a cycle in which a home position at a predetermined point of the ITB 156 is sensed. Assuming that the home positioned at the predetermined point of the ITB 156 is sensed in the cycle of 3.75 seconds, it takes 200 ms to turn on the pick up solenoid 160, and it takes 600 ms to sense the printing paper of the registration sensor 176 after the printing paper is picked up, the number of times the image forming apparatus retries picking up the printing paper is limited to 4 times (3.75 sec/800 ms) for one cycle of the ITB 156. Accordingly, the number of times the image forming apparatus retries picking up the printing paper may be set between one to four times by a user per cycle of the ITB 156 or as determined during manufacture. Further, the method is not limited thereto such that the ITB 156 may be cycled several times to allow for an increased number of attempts to pick up the printing paper.

In an embodiment of the present invention, in operation 240, the image forming apparatus may determine to retry picking up the printing paper when the home of the ITB 156 is sensed. A home sensor (not shown) senses the home of the ITB 156 each time the ITB 156 makes one revolution. The image forming apparatus synchronizes rotation of the ITB 156 with conveyance of the printing paper using a result of sensing of the home of the ITB 156, so that the printing data can be transferred at a precise position of the printing paper. However, when transferring the printing data from the ITB 156 to the printing paper fails due to mis-pick up, the ITB 156 needs to make further revolution in order to synchronize the rotation of the ITB 156 with the conveyance of the printing paper again. The ITB 156 may make at least one more revolution. The image forming apparatus may retry picking up the printing paper depending on whether the home sensor senses the home of the ITB 156.

In operation 250, the image forming apparatus retries picking up the printing paper. In operation 260, the image forming apparatus senses if the printing paper is picked up. When the image forming apparatus neither picks up the printing paper nor senses the printing paper, the process returns to operation 240. When the image forming apparatus senses the printing paper, the process proceeds to operation 270.

In operation 270, the image forming apparatus transfers the printing paper to a transfer unit (not shown) to transfer the printing data to the printing paper. Similar to FIG. 1, the transfer unit may include the second transfer roller 153, the ITB 156, and driving rollers 159. When the printing paper is conveyed to the transfer unit, the printing paper passes between the ITB 156 and the second transfer roller 153 so that the printing data is transferred to the printing paper put in the ITB 156.

In operation 280, after transferring the printing data to the printing paper, when the cleaning blade is separated from the ITB 156, the image forming apparatus moves the cleaning blade to a position where the printing data can be removed from the ITB 156, and removes the printing data from the ITB 156.

In operation 290, the image forming apparatus outputs an error message. Error messages that the image forming apparatus may output are divided into messages JamA, JamB, and JamC. Referring to FIG. 1, the message JamA is output when the registration sensor 176 does not sense the printing paper. The message JamB is output when the registration sensor 176 senses the printing paper but the registration sensor 176 still senses the printing paper after a predetermined amount of time or when the registration sensor 176 senses the printing paper but an output sensor 193 cannot sense the printing paper after a predetermined amount of time. The message JamC is output when the output sensor 193 senses the printing paper but the output sensor 193 still senses the printing paper after a predetermined amount of time. Accordingly, when it is determined in operation 240 that picking up the printing paper is not to be retried, the image forming apparatus outputs the error message JamA in operation 290. Also, the error message JamA may be output when a user retries picking up the printing paper more than a predetermined number of times.

In operation 295, the image forming apparatus transfers the printing paper to the transfer unit in order to transfer the printing data to the printing paper. Similar to FIG. 1, the transfer unit may include the second transfer roller 153, the ITB 156, and the driving rollers 159. When the printing paper is conveyed to the transfer unit, the printing paper passes between the ITB 156 and the second transfer roller 153, so that the printing data is transferred to the printing paper in the ITB 156.

FIG. 3 is a block diagram of an image forming apparatus according to an embodiment of the present invention. Referring to FIG. 3, the image forming apparatus includes a pick up sensing unit 310, a transfer unit 320, a pick up unit 330, an ITB 340, a cleaning blade 350, a conveyance unit 360, and an error output unit 370. While not restricted thereto, the image forming apparatus can be a stand alone printer, or a multi-function machine including addition facsimile, copying, and or scanning capabilities.

The pick up sensing unit 310 senses if the pick up unit 330 picks up printing paper. After the printing paper is picked up, when the pick up sensing unit 310 does not sense the printing paper in a predetermined amount of time, the pick up sensing unit 310 determines that the printing paper is not picked up and transmits a control signal to the pick up unit 330 so that the pick up unit 300 can retry picking up the printing paper.

After the printing paper is picked up, when the pick up sensing unit 310 does not sense the printing paper in a predetermined amount of time, the pick up sensing unit 310 outputs a control signal to the ITB 340 so that the ITB 340 makes an additional revolution, and outputs a separation signal to the cleaning blade 350 to separate a cleaning blade from the ITB 340. However, after the printing paper is picked up, when the pick up sensing unit 310 senses the printing paper in a predetermined amount of time, the pick up sensing unit 310 transmits a paper pick up signal to the conveyance unit 360.

The transfer unit 320 transfers printing data to the ITB 340, and may be an OPC drum (similar to reference number 140 in FIG. 1). The pick up unit 330 may retry picking up the printing paper in response to the control signal output from the pick up sensing unit 310. The pick up unit 330 may include a pick up solenoid (similar to reference number 160 in FIG. 1) and a pick up roller (similar to reference number 163 in FIG. 1). When the pick up sensing unit 310 senses that the printing paper is not picked up, the pick up unit 330 retries picking up the printing paper considering a cycle of revolution of the ITB 340. In such case, the pick up unit 330 may retry picking up the printing paper a predetermined number of times. The predetermined number of times may be calculated considering the cycle of revolution of the ITB 340 and a time taken to pick up the printing paper. Alternatively, the pick up unit 330 may retry picking up the printing paper depending on whether a predetermined point in the ITB 340 is sensed. The ITB 340, on which the printing data is transferred by the transfer unit 320, may make additional revolutions when the pick up sensing unit 310 determines that the printing paper is not picked up.

When the pick up sensing unit 310 determines that the printing paper is not picked up, the cleaning blade 350 is separated from the ITB 340 so that the printing data is not removed but remains on the ITB 340. The cleaning blade 350 removes the printing data from the ITB 340 when in contact with the ITB 340. After the cleaning blade 350 is separated from the ITB 340, when the pick up sensing unit 310 senses that the printing paper is picked up or when the error output unit 370 outputs an error message, the cleaning blade 350 is moved to a position to remove the printing data transferred to the ITB 340.

The conveyance unit 360 receives the paper pick up signal from the pick up sensing unit 310 and conveys the printing paper to a transfer unit (not shown) to transfer an image to the printing paper. The transfer unit may include a second transfer roller (similar to reference number 153 in FIG. 1), an ITB (similar to reference number 156 in FIG. 1), and driving rollers (similar to reference number 159 in FIG. 1).

After the pick up unit 330 retries picking up the printing paper a predetermined number of times or a number of times set by a user, when the pick up sensing unit 310 senses that the printing paper is still not picked up, the error output unit 370 outputs an error message.

The embodiments of the present invention can further be written as computer programs and can be implemented in general-use digital computers that execute the programs using a computer readable recording medium. Also, data used in the embodiments of the present invention can be recorded on the computer readable recording medium using a variety of units. Examples of the computer readable recording medium include magnetic storage media (e.g., ROM, floppy disks, hard disks, etc.), optical recording media (e.g., CD-ROMs, or DVDs). Such code could be used in a controller controlling each of the pick up unit, cleaning blade, pick up sensing unit, error output unit, conveyance unit, transfer unit, ITB, as well as others. Further, such code can be transmitted, such as in carrier waves for transmission through the Internet.

According to the embodiments of the present invention, when mechanical mis-pick up occurs, an image forming apparatus automatically retries picking up printing paper under predetermined conditions, thereby reducing the occurrence frequency of errors and thus increasing a user's convenience. Also, in a multi-pass image forming apparatus, even if mis-pick up occurs, printing data is transferred to an ITB. Therefore, the image forming apparatus according to aspects of the present invention can accurately use the printing data transferred to the ITB and decrease wasting of toner.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of forming an image for an image forming apparatus, the method comprising:

determining if printing paper is properly picked up after an attempt by the image forming apparatus to pick up the paper;

transferring printing data to an intermediate transfer belt (ITB) of the image forming apparatus;

separating a cleaning blade from the ITB to keep the printing data on the ITB when the printing paper is determined to not be properly picked up after transferring the printing data to the ITB;

synchronizing the rotation of the ITB by sensing of a home of the ITB so that printing data can be in the precise location to transfer the image to printing paper;

retrying the picking up of the printing paper multiple times per one full rotation of the ITB when the printing paper is determined to not be properly picked up; and wherein the cleaning blade is separated from the ITB during retrying of the picking up, wherein the cleaning blade removes transferred printing data on the ITB when the cleaning blade is in contact with the ITB.

2. The method of claim 1, wherein the retrying of the picking up comprises rotating the ITB at least one revolution when the printing paper is not properly picked up.

3. The method of claim 1, wherein the retrying of the picking up the printing paper comprises retrying the picking up of the printing paper a predetermined number of times when the printing paper is not properly picked up according to the revolution cycle of the ITB and a time necessary to pick up the printing paper.

4. The method of claim 1, wherein the retrying of the picking up the printing paper comprises retrying the picking up of the printing paper according to whether a predetermined point in the ITB is sensed when it is sensed that the printing paper is not properly picked up.

5. The method of claim 1, wherein the retrying of the picking up of the printing paper further comprises re-sensing if the printing paper is properly picked up.

6. The method of claim 5, further comprising performing a printing operation on the printing paper when the printing paper is properly picked up.

7. The method of claim 5, further comprising outputting an error message when the printing paper is not properly picked up after retrying the picking up of the printing paper a predetermined number of times or a number of times set by a user.

8. The method of claim 1, further comprising, after separating the cleaning blade from the ITB, moving the cleaning blade to a position to remove the printing data after the printing paper is properly picked up and the printing data is transferred to the printing paper or when an error message is generated to indicate that the printing paper is not properly picked up.

9. The method of claim 1, further comprising retrying the picking up of the printing paper according to a predetermined number of retries.

10. The method of claim 9, further comprising rotating the ITB for at least one more revolution if the predetermined number of retries is greater than a number of retries possible in one revolution of the ITB.

11. A non-transitory computer-readable medium having embodied thereon a computer program for executing the method of claim 1.

12. The image forming apparatus of claim 1, wherein the retrying occurs when the ITB is in a home position to allow the ITB to be synchronized with paper conveyance.

13. A method of forming an image for an image forming apparatus, the method comprising:

determining if printing paper is properly picked up after an attempt by the image forming apparatus to pick up the paper;

transferring printing data to an intermediate transfer belt (ITB) of the image forming apparatus;

synchronizing the rotation of the ITB by sensing of a home of the ITB so that printing data can be in the precise location to transfer the image to printing paper;

retrying the picking up of the printing paper according to a predetermined number of retries per one full rotation of the ITB when the printing paper is not properly picked up after transferring the printing data to the ITB; and removing a cleaning blade from the ITB until the paper is properly picked up or the picking up of the printing paper has failed to properly pick up the paper in the predetermined number of retries, wherein the cleaning blade is separated from the ITB during retrying of the picking up;

wherein the predetermined number of retries per one full rotation of the ITB comprises at least two retry attempts per one full rotation of the ITB.

14. The method of claim 13, wherein the predetermined number of retries is determined according to a revolution cycle of the ITB.

15. A method of forming an image for an image forming apparatus, the method comprising:

determining if printing paper is properly picked up after an attempt by the image forming apparatus to pick up the paper;

transferring printing data to an intermediate transfer belt (ITB) of the image forming apparatus after transferring the printing data to the ITB;

synchronizing the rotation of the ITB by sensing of a home of the ITB so that printing data can be in the precise location to transfer the image to printing paper;

retrying the picking up of the printing paper according to a predetermined number of retries per one full rotation of the ITB when the printing paper is not properly picked up after transferring the printing data to the ITB; and selectively separating a cleaning blade from the ITB when the printing paper is determined to be not properly picked up to prevent the cleaning blade from removing the printing data from the ITB, wherein the cleaning blade is separated from the ITB during retrying of the picking up;

wherein the predetermined number of retries per one full rotation of the ITB comprises at least two retry attempts per one full rotation of the ITB.

* * * * *